US006032316A

United States Patent [19]

Peake et al.

[11] Patent Number: 6,032,316

[45] Date of Patent: Mar. 7, 2000

[54] FOLDABLE SHOE CLEANING BRUSH

[75] Inventors: Charles D. Peake, Kalamazoo, Mich.; Kenneth Hyotlaine, Palm City, Fla.

[73] Assignee: PVM Enterprises, L.L.C., Richland, Mich.

[21] Appl. No.: 09/071,313

[22] Filed: May 1, 1998

Related U.S. Application Data

[60] Provisional application No. 60/061,600, Oct. 10, 1997.

[51] Int. Cl.[7] ..... A46B 15/00; A47L 23/00

[52] U.S. Cl. ..... 15/161; 15/237

[58] Field of Search ..... 15/161, 160, 215, 15/217, 185, 237, 238, 203, 241, 239, 240, 172, 112, 165

[56] References Cited

U.S. PATENT DOCUMENTS

| | | | |
|---|---|---|---|
| D. 375,039 | 10/1996 | Carroll | D8/354 |
| D. 381,138 | 7/1997 | Taylor | D32/14.1 |
| 817,337 | 4/1906 | Purdy | 15/165 |
| 1,479,644 | 1/1924 | Browne | 15/161 |
| 1,507,150 | 9/1924 | Behrens | 15/165 |
| 2,217,570 | 10/1940 | Stroup | 15/215 |
| 2,832,979 | 5/1958 | Troyer | 15/112 |
| 3,028,617 | 4/1962 | Racina | 15/161 |
| 4,718,138 | 1/1988 | Brown et al. | 15/237 |
| 5,075,917 | 12/1991 | Wheat et al. | 15/161 |
| 5,437,075 | 8/1995 | Peake | 15/161 |
| 5,479,674 | 1/1996 | Gilcrest | 15/161 |
| 5,636,404 | 6/1997 | Ribera | 15/161 |

*Primary Examiner*—Gary K. Graham

*Attorney, Agent, or Firm*—Gifford, Krass, Groh, Sprinkle, Anderson & Citkowski, P.C.

[57] ABSTRACT

A stowable brush assembly includes a support body having a brush retainer pivotably affixed to it so that the brush retainer can be moved from a storage position in which it overlies, and is generally parallel to the support body to a use position in which it is disposed at an angle relative to the support body. An operating lever engages the brush retainer and pivots it from the storage position to the use position.

12 Claims, 2 Drawing Sheets

FOLDABLE SHOE CLEANING BRUSH

RELATED APPLICATION

This patent application claims priority of provisional patent application No. 60/061,600 filed Oct. 10, 1997.

FIELD OF THE INVENTION

This invention relates generally to brushes. More specifically, the invention relates to brushes for cleaning mud and debris from shoes, particularly golf cleats. Most specifically, the invention relates to a golf cleat cleaning brush which may be mountable onto a golf cart and which may be moved between a use position and a storage position.

BACKGROUND OF THE INVENTION

Sporting shoes such as golf cleats and the like accumulate mud and other debris. Consequently, golfers often carry a shoe cleaning brush for the purpose of removing such debris from their cleats. It is desirable to mount a golf cleat cleaning brush onto a golf cart or the like; however, some problems are encountered with cart mounted brushes, since such brushes must project from the cart at a location readily accessible to the golfer and must do so with sufficient rigidity to permit the golfer to scrub dirt from his or her cleats. The rigid mounting and accessible location of prior art cleat cleaners can cause injury to a player who walks into a cleat cleaning brush, or is struck by a cleat cleaning brush on a passing golf cart. Similarly, impact with a golfer, a tree, or rough ground can damage the brush and/or cart. Consequently, it is desirable that any cart mounted cleat cleaning brush be deployable from a use position, in which it is accessible to the golfer, to a storage position in which it is safely removed from access.

A number of approaches have been implemented in the prior art mounting cleaning brushes onto support structures such as golf carts and the like. U.S. Pat. No. 5,075,917discloses a flexible, belt-like brush which is wrapped about, and affixed to the bumper of a golf cart. This brush is not foldable from a storage to a use position, and relies upon the bumper of the golf cart to provide rigidity. U.S. Pat. No. 5,437,075 discloses a self-storing brush configured to be mounted to the bumper of a golf cart. This brush is of different configuration from that of the present invention, but does provide for folding of the brush from a storage to a use position. Patent D381,138 discloses a brush which is configured to be mounted onto a vehicle. The brush is hinged to an attachment bracket and includes a spring which allows it to be folded. Patent D375,039 discloses a brush which is rigidly affixed to the frame of a golf cart, and does not include any provision for folding. U.S. Pat. No. 5,636,404 shows a cloth belt which is attached to a vehicle and which retains a folding shoe brush. U.S. Pat. No. 5,479,674 shows a hinged shoe brush assembly which attaches to a golf bag, and U.S. Pat. No. 4,718,138 shows a boot scraper that attaches to a ski pole.

As will be explained in detail hereinbelow, the present invention provides a brush assembly which is readily affixable to a golf cart or to a stationary support and which can be simply and easily folded from a storage to a use position. In the storage position, the brush assembly is relatively flat and includes no sharp projecting portions which could cause injury. In its use position, the brush is very rigid and will support a fairly large amount of weight, and will not be dislodged by vigorous use. The brush assembly of the present invention is easily mounted onto a variety of supports, and is simple to operate. These and other advantages of the present invention will be apparent from the drawings, discussion and description which follow.

BRIEF DESCRIPTION OF THE INVENTION

There is disclosed herein a stowable brush assembly which comprises a support body and a brush retainer which is configured to retain a brush upon a first surface thereof. The brush retainer is attached to the support body so that it can be pivoted from a storage position in which it is disposed generally parallel to the support body, to a use position in which it is disposed at an angle relative to the support body. The assembly also includes an operating lever which is affixed to the support body so as to be pivotable from a first position in which a leg portion of the operating lever is disposed generally parallel to the support body, to a second position in which the leg portion is disposed so as to project from the support body and engage the brush retainer. As the leg portion of the operating lever is moved from its first position to its second position, it moves the brush retainer from the storage position to the use position. In specific embodiments, the brush assembly also includes a handle which forms a part of the operating lever, and which may be used to move the leg portion from its first to its second position. The brush assembly may further include an attachment bracket or similar means for affixing it to a golf cart or other support member. In some embodiments, the brush retainer has a brush which is integral therewith, while in other instances, the brush retainer is configured to releasably retain a separate brush so as to allow for replacement of only the brush portion of the assembly.

DETAILED DESCRIPTION OF THE INVENTION

Figure 1:
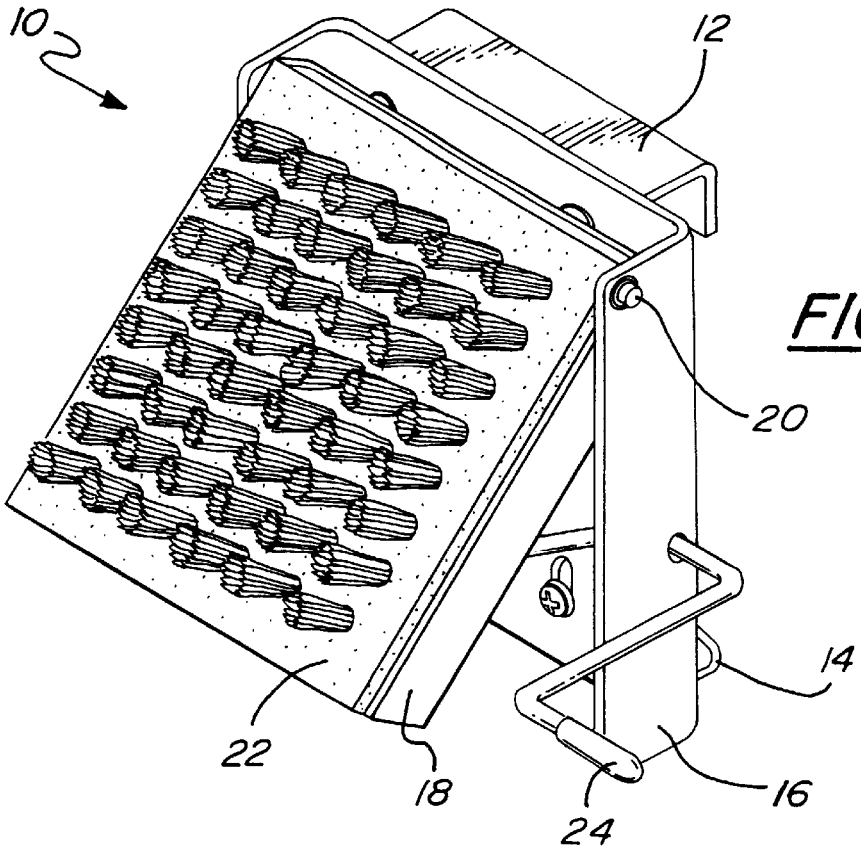
FIG. 1 is a perspective view of one embodiment of brush assembly structured in accord with the present invention.

The present invention is directed to a foldable brush assembly which is configured to be mounted to a vehicle such as a golf cart or the like, or to a stationary support member. Most preferably, the brush assembly is configured as a cleat cleaner for golf shoes. Referring now to FIG. 1, there is shown a perspective view of one embodiment of cleat cleaning brush assembly 10 structured in accord with the principles of the present invention. The assembly 10 includes a top bracket 12 and a bottom bracket 14 which may be used to mount the brush assembly onto the bumper of a golf cart. It is to be understood that in other embodiments of the invention, differently configured mounting brackets may be employed. The brush assembly 10 further includes a body portion comprising a support member 16 having a brush retainer 18 pivotably attached thereto by a hinge pin 20. In this embodiment, the brush retainer 18 is a generally U-shaped member configured to receive and retain a brush 22 therein so as to permit for replacement of the brush as it becomes worn. In other embodiments, the brush 22 and brush retainer 18 comprise a single, integral unit pivotably attached to the support body 16. In the FIG. 1 embodiment, the hinge pin 20 passes through the brush retainer 18 and through the body of the brush so as to affix the brush 22 to the retainer 18. In this instance, the brush may be readily replaced by withdrawing the hinge pin 20. In other embodiments, the retainer 18 may include clips, clamps or the like for retaining the brush.

The brush assembly 10 further includes an operating lever 24 which, as will be described in detail hereinbelow, operates to pivot the brush retainer 18 from a storage position, in which the brush retainer 18 and the support member 16 are generally coplanar, to a use position, as illustrated in FIG. 1, wherein the brush retainer 18 and support member 16 are disposed at an acute angle relative to one another.

Figure 2:
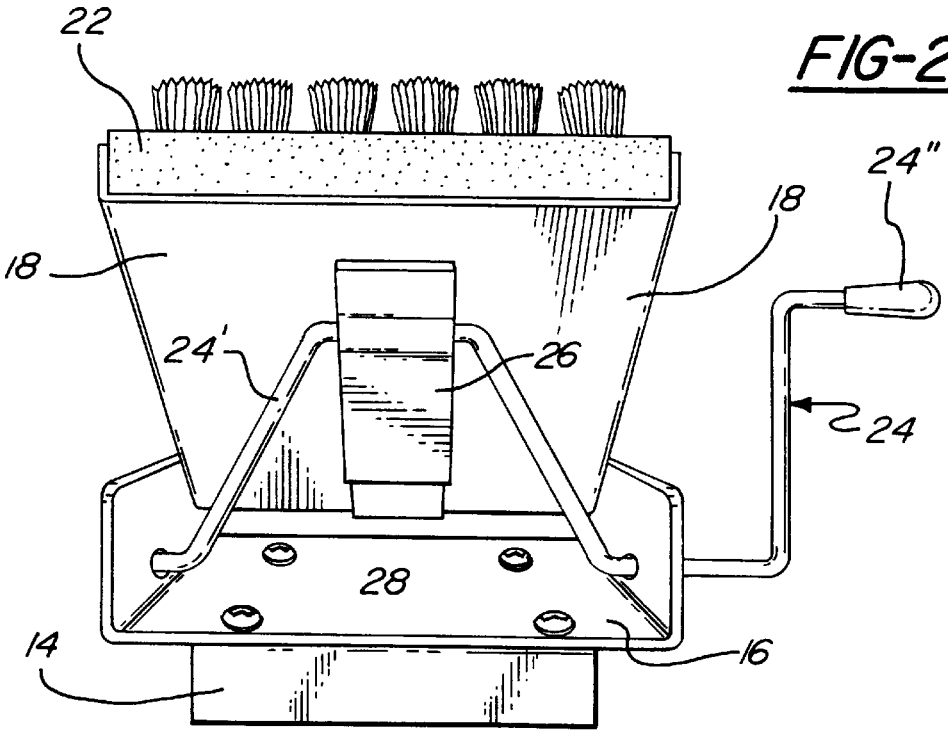
FIG. 2 is a front perspective view of the brush assembly of FIG. 1 showing the brush retainer in its use position.

Referring now to FIG. 2, there is shown a front, perspective view of the brush assembly 10 of FIG. 1 in the use position. As shown in FIG. 2, the brush retainer 18, which in this instance comprises a generally U-shaped metal member, retains a brush 22 therein. The brush support 18 and associated brush 22 are in turn retained by the support body 16, which in this instance is also a U-shaped metal member. Operating lever 24 is pivotably supported by the support body 16, and this operating lever includes a central, bent leg portion 24' which is moved from a first position in which it is generally parallel to the support body 16, to a second position in which it projects from the support body 16. The leg portion 24' is pivoted by rotation of the handle portion 24" of the lever 24. The leg portion 24' of the lever 24 engages a guide loop 26 which is affixed to the bottom surface of the brush retainer 18. In this manner, the operating lever functions to pivot the brush retainer 18 from a storage position to the illustrated use position. Also shown in FIG. 2 are bolts 28 which function to retain the support brackets 14, 12 on the support body.

Figure 3:
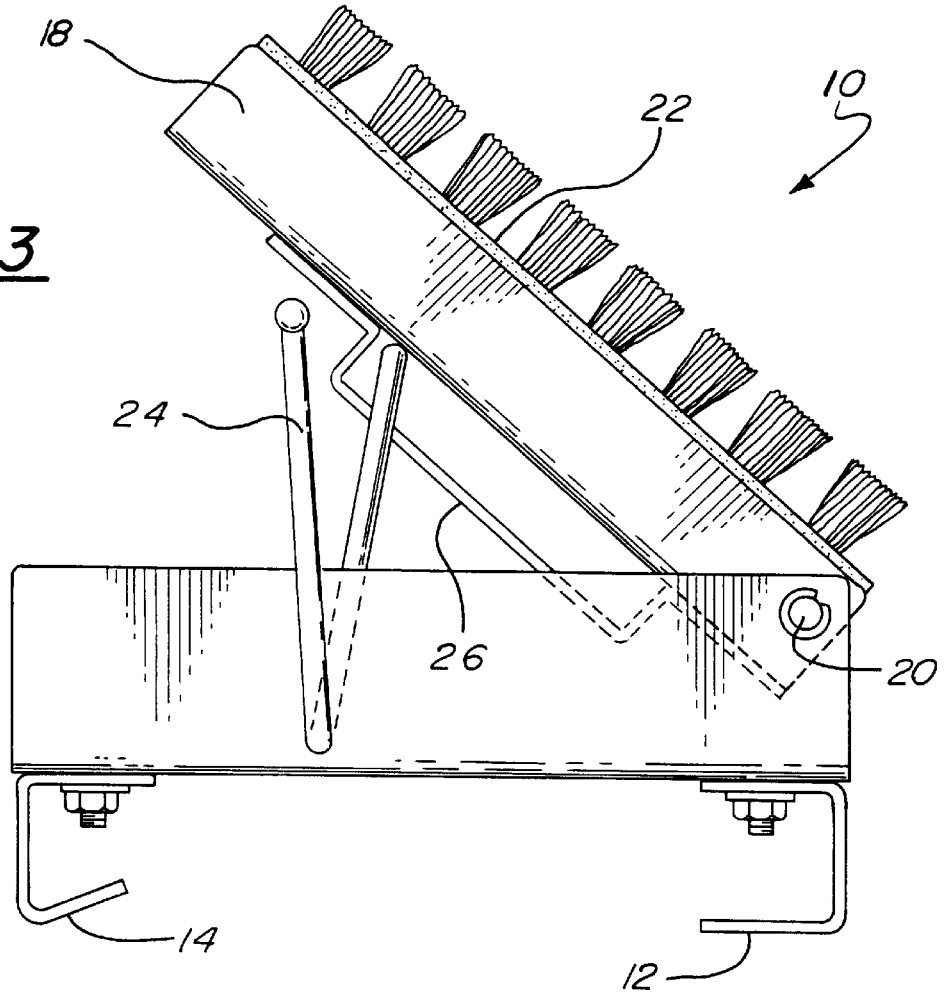
FIG. 3 is a side elevational view of the brush assembly of FIGS. 1 and 2 as shown in its use position.

Referring now to FIG. 3, there is shown a side elevational view of the assembly 10 of FIGS. 1 and 2 in its use position. FIG. 3 more clearly illustrates the manner in which the leg portion 24' of the operating lever 24 engages the brush support 18 and guide loop 26. It will be appreciated from FIG. 3 that the guide loop 26 and bottom surface of the brush retainer 18 cooperate with the leg portion 24' to provide a detent feature which serves to maintain the brush assembly in its use position. Rotation of the operating lever 24 biases the brush retainer 18 toward a right angle with the support body 16, and the brush retainer 18 and associated brush 22 will then fall to the storage position.

Figure 4:
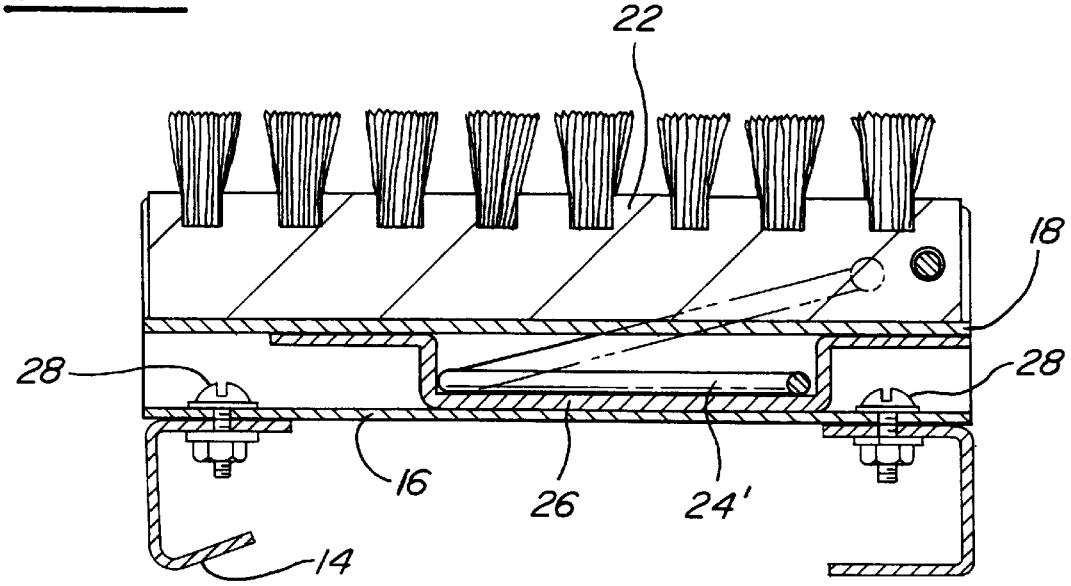
FIG. 4 is a cross-sectional view of the brush assembly of FIGS. 1–3 taken at an approximate midline thereof, showing the assembly in its storage position.

Referring now to FIG. 4, there is shown a cross-sectional view of a brush assembly generally similar to that shown in FIGS. 1–3. The cross-section is taken along the approximate midline of the brush assembly, and shows the assembly in its storage position. As can be seen from FIG. 4, the brush 22, brush retainer 18, support body 16, guide loop 26, and leg portion 24' of the operating lever are all disposed in a generally coplanar relationship. In a typical application, the assembly is mounted onto the bumper of a golf cart or similar vehicle by means of the mounting brackets 12 and 14, such that bracket 12 is topmost. In this manner, gravity will assist in the folding of the assembly, and will tend to maintain the assembly in its folded condition.

The assembly of the present invention may be fabricated from a variety of materials, with some particularly preferred materials being metal such as steel, aluminum, brass and the like. Alternatively, at least some parts of the assembly may be fabricated from polymeric materials, with fairly high strength engineering polymers such as polycarbonate, ABS, and fiber reinforced composites being particularly preferred.

It will be appreciated from the foregoing drawings that the assembly of the present invention may be readily moved from a storage position to a use position by rotation of the operating lever, and this rotation may be accomplished by a simple foot or hand action of the user. When the assembly is in its use position, it is relatively rigid, and will accommodate fairly heavy foot pressure, without bending or folding. When the assembly is in its storage position, it is relatively compact, and does not present a hazard.

It is to be understood that the brush assembly of the present invention may be manufactured in configurations other than those shown herein. For example, the brush and/or brush retainer may be curved concavely, convexly or otherwise. For example, the brush may comprise a generally U-shaped brush which will clean the sides and bottoms of a shoe simultaneously. Alternatively, the brush may be cylindrical or otherwise configured. The mounting brackets may be varied in configuration, number and placement so as to permit the assembly to be mounted onto a variety of substrates. For example, the mounting bracket may comprise one or more mounting loops for affixation of the brush assembly to a post. This type of mounting will permit the assembly to be affixed to tubular portions of a golf cart frame, or to be affixed to a nonmobile post. In some embodiments, a spring or other biasing means may be included to facilitate folding of the assembly. All of such modifications and variations are within the scope of the present invention, and in view of the disclosure herein numerous other modifications and variations may be implemented by one of skill in the art. The foregoing drawings, discussion and description are illustrative of particular embodiments of the invention and are not meant to be limitations upon the practice thereof. It is the following claims, including all equivalents, which define the scope of the invention.

We claim:

1. A stowable brush assembly comprising:

a support body;

a brush retainer which is configured to retain a brush on a front surface thereof, and which is pivotably attached to said support body so as to be pivotable from a storage position, in which the brush retainer is disposed generally parallel to said support body, to a use position in which the brush retainer is disposed at an acute angle relative to said support body; and an operating lever which is supported by said support body, so as to be pivotable from a first position in which a leg portion of said operating lever is disposed generally parallel to said support body, to a second position in which the leg portion is disposed so as to project from said support body and to engage a rear surface of said brush retainer so as to bias said brush retainer to said use position.

2. A brush assembly as in claim 1, wherein said brush retainer further includes a guide loop disposed upon a back surface thereof and wherein a segment of the leg portion of the operating lever is retained by said guide loop.

3. A brush assembly as in claim 2, wherein said guide loop and said segment of said leg portion cooperate to provide a detent which maintains said brush retainer in said use position.

4. A brush assembly as in claim 1, wherein said operating lever includes a handle portion which passes through an opening in said support body, and which is in mechanical communication with the leg portion of said operating lever.

5. A brush assembly as in claim 1 further including attachment means for releasably affixing said brush assembly to another member.

6. A brush assembly as in claim 5, wherein said attachment means includes a top bracket and a bottom bracket affixed to said support body in a spaced apart relationship.

7. A brush assembly as in claim 1, wherein said brush retainer is configured to releasably retain a brush.

8. A brush assembly as in claim 1, further including a brush, wherein said brush is an integral part of said brush retainer.

9. A brush assembly as in claim 1, wherein said brush retainer is pivotally attached to said support body by a pivot pin which passes through said support body and brush retainer.

10. A brush assembly as in claim 9, further including a brush, and wherein said pivot pin passes through said brush so as to affix said brush to said brush retainer.

11. A stowable brush assembly which is configured to be attached to a golf cart, said brush assembly comprising:

a support body;

a brush retainer which is configured to retain a brush thereupon, and which is pivotably attached to said support body so as to be pivotable from a storage position in which the brush retainer is disposed generally parallel to said support body, to a use position in which the brush retainer is disposed at an acute angle relative to said support body;

a guide loop disposed upon a rear surface of said brush retainer;

an operating lever which includes a handle portion and a leg portion in mechanical communication therewith, said leg portion including a segment which passes through said guide loop, said operating lever being supported by said support body so as to be pivotable from a first position in which the leg portion of said operating lever is disposed generally parallel to said support body, to a second position in which the leg portion is disposed so as to project from said support body and to engage the bottom face of said brush retainer and said guide loop so as to bias said brush retainer to said use position.

12. A stowable brush assembly comprising:

a support body;

a brush retainer which is configured to retain a brush thereupon, and which is pivotably attached to said support body so as to be pivotable from a storage position, in which the brush retainer is disposed generally parallel to said support body, to a use position in which the brush retainer is disposed at an acute angle relative to said support body; and an operating lever which includes a handle portion and a leg portion in mechanical communication therewith, said handle portion passing through an opening in said support body, said operating lever being supported by said support body, so as to be pivotable from a first position in which the leg portion is disposed generally parallel to said support body, to a second position in which the leg portion is disposed so as to project from said support body and to engage said brush retainer so as to bias said brush retainer to said use position.

* * * * *